US005701781A

United States Patent [19]

Giles

[11] Patent Number: 5,701,781

[45] Date of Patent: Dec. 30, 1997

[54] SYSTEM AND METHOD FOR CONTROLLING MOVEMENT OF A TRANSFER SYSTEM

[75] Inventor: Lyle T. Giles, Harper Woods, Mich.

[73] Assignee: Livernois Research & Development Company, Dearborn, Mich.

[21] Appl. No.: 676,533

[22] Filed: Jul. 9, 1996

[51] Int. Cl.[6] ..... B21D 43/05

[52] U.S. Cl. ..... 72/405.12; 72/405.01; 198/861.5; 198/621.3

[58] Field of Search ..... 72/405.1–405.16, 72/405.01; 470/95, 109, 154; 198/861.5, 861.6, 621.3

[56] References Cited

U.S. PATENT DOCUMENTS

| | | | |
|---|---|---|---|
| 4,186,589 | 2/1980 | Criblez . | |
| 4,411,587 | 10/1983 | Niki | 72/405.1 |
| 4,449,390 | 5/1984 | Pontini . | |
| 4,585,389 | 4/1986 | Watanabe | 72/405.1 |
| 4,589,819 | 5/1986 | Shirao | 72/405.12 |
| 5,035,134 | 7/1991 | Fisch . | |
| 5,131,256 | 7/1992 | Sofy . | |
| 5,136,874 | 8/1992 | Fisch . | |
| 5,140,839 | 8/1992 | Bruns . | |
| 5,390,525 | 2/1995 | Fisch . | |

OTHER PUBLICATIONS

"Designing Transfer Dies", Fall 1989 *Stamping Quarterly*.

*Primary Examiner*—Daniel C. Crane
*Attorney, Agent, or Firm*—Brooks & Kushman P.C.

[57] ABSTRACT

A system and method for controlling movement of a transfer system (22) between operable and serviceable positions in a manufacturing system such as a stamping press (10) includes a crank arm (60) and a plurality of swing arms (66, 76). The swing arms (66, 76) connect the crank arm (60) to the transfer system (22) and define a plurality of pivot connections with each other so as to allow controlled movement of the transfer system (22) between operable and serviceable positions when the crank arm (60) is driven. A plurality of gears (82, 84, 86, 88) including a reference gear (82) fixed to the stamping press (10) and an object gear (84) fixed to the transfer system (22) are used to control transfer system attitude during movement. Drive means (94, 96) interconnect the plurality of gears (82, 84, 86, 88) to rotate the transfer system (22) by rotating the object gear (84) together with the transfer system (22) as the crank arm (60) is driven.

19 Claims, 5 Drawing Sheets

SYSTEM AND METHOD FOR CONTROLLING MOVEMENT OF A TRANSFER SYSTEM

TECHNICAL FIELD

The present invention relates to a system and method for controlling movement of a transfer system between operable and serviceable positions in a manufacturing system such as a stamping press.

BACKGROUND ART

In a stamping operation, transfer systems are used to index workpieces between workstations within the stamping press. The transfer system generally includes at least one set of gripping assemblies for securing a workpiece. The transfer system is capable of engaging and securing the workpiece, lifting the workpiece from the lower die, indexing the workpiece to the next workstation, and re-positioning the same workpiece on the next lower die. The transfer system is also capable of moving workpieces to the stamping press from a load station, and moving workpieces from the stamping press to an unload station.

Conventionally, a lower die arrangement is positioned on the press bed, and an upper die arrangement is mounted for reciprocal motion toward and away from the lower die for performing the stamping operation. An example of an existing transfer system for a stamping press is shown in U.S. Pat. No. 5,390,525 issued to Fisch. This patent shows a transfer system that is selectively swingable away in an arc of fixed radius from the press about a fixed axis to a serviceable position. This allows access to the die area for maintenance, repair, or die change-over. However, in the serviceable position, the transfer system is inverted, which unnecessarily encumbers tasks that must be performed.

A primary disadvantage associated with existing transfer systems is the fact that many times there are space constraints due to die location, press geometry, or other nearby equipment. These constraints or other workplace constraints make fixed axis swing-away type arrangements undesirable. Further, the operable position for the transfer system may vary with each custom stamping application. A fixed-axis swing-away type transfer system does not provide versatility in its operable and serviceable positions to meet the demands of custom stamping applications.

SUMMARY OF THE INVENTION

It is, therefore, an object of the present invention to provide a system and method for controlling movement of a transfer system between operable and serviceable positions.

It is another object of the present invention to provide an improved transfer system that allows versatility in selection of the operable and serviceable positions to meet the demands of custom stamping applications.

In carrying out the above objects and other objects and features of the present invention, a linkage for connecting a transfer system to a manufacturing system such as a stamping press is provided. A driveable crank arm is mounted to the stamping press, and a lead arm has an intermediate section pivotally attached to the crank arm. A follow arm has a base end mounted to the stamping press, and a free end attached to a tail end of the lead arm. The head end of the lead arm is mounted to the transfer system so as to allow controlled movement of the transfer system between an operable position and a serviceable position when the crank arm is driven.

The crank arm, lead arm, and follow arm each have predetermined lengths based on desired operable and serviceable positions for the transfer system and a desired path of movement therebetween. A reference gear is fixedly mounted to the stamping press to preclude rotation of the reference gear with respect to the stamping press, and an object gear is fixedly mounted to the transfer system to preclude rotation of the object gear with respect to the transfer system. A first free gear is mounted for rotation at the free end of the follow arm. A second free gear is mounted for rotation at the tail end of the lead arm and is coupled to the first free gear for rotation together. The reference gear and first free gear are connected by a drive means such as a timing chain. A second drive means connects the second free gear and object gear.

The first free gear rotates as the free end of the follow arm moves in response to the crank arm being driven. This causes the second free gear to rotate, which rotates the object gear, rotating the transfer system together with the object gear.

A method for controlling movement of the transfer system includes determining operable and serviceable positions for the transfer system, and selecting crank arm, lead arm, and follow arm lengths based on the operable and serviceable positions. The gears have predetermined gear ratios based on desired transfer system attitudes during movement of the transfer system between the operable and serviceable positions.

The advantages accruing to the present invention are numerous. For example, the system and method of the present invention provide an articulating, swing and lift feature for the transfer system that can be custom designed for each individual unique application. Transfer system movement is determined by selecting appropriate crank arm, lead arm, and follow arm lengths, and by selecting appropriate gear ratios. If desired, the transfer system may remain horizontal (i.e. not inverted) in the serviceable position.

The above objects, and other objects, features and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
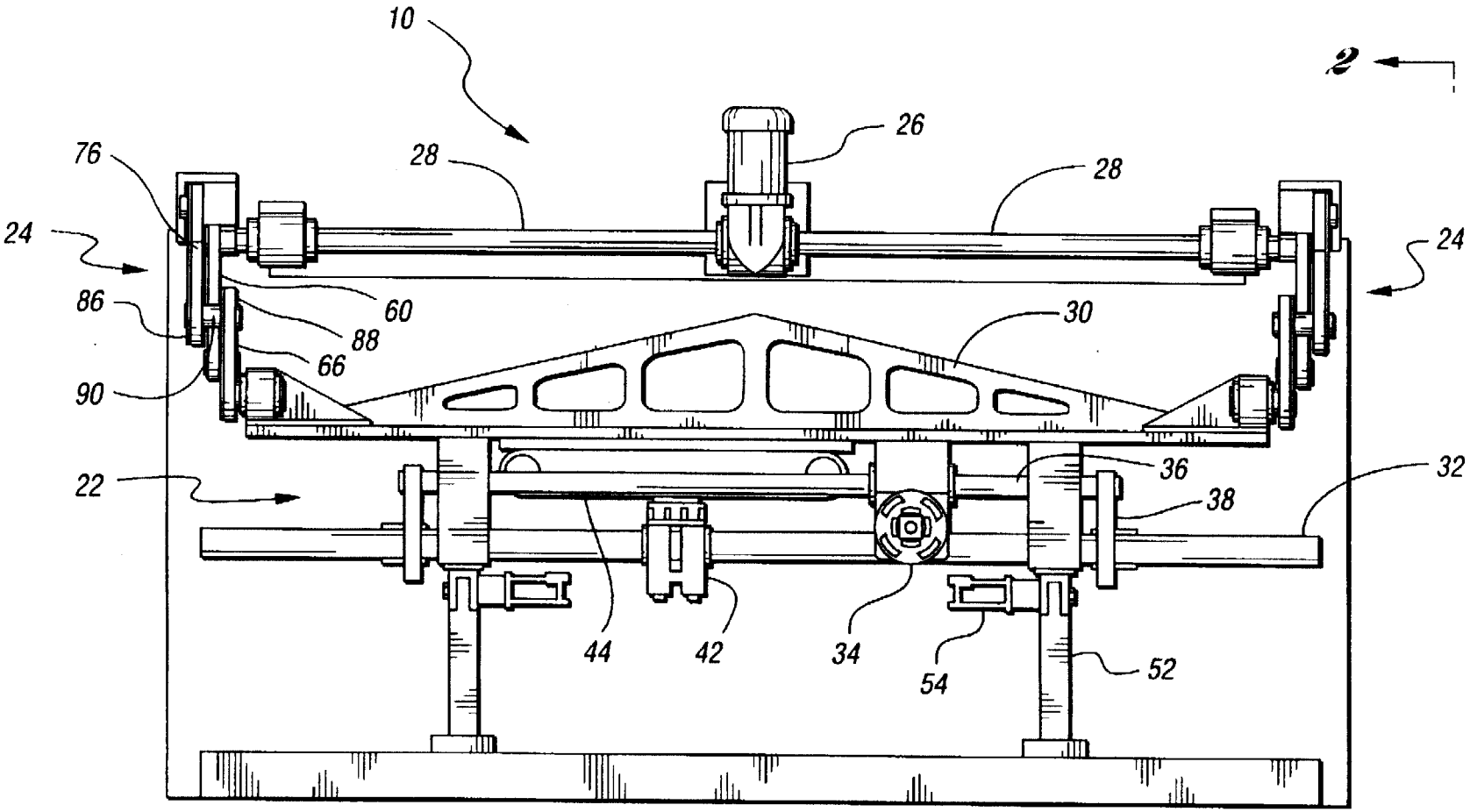
FIG. 1 is a side view of a transfer system mounted to a stamping press in accordance with the present invention.
Figure 2:
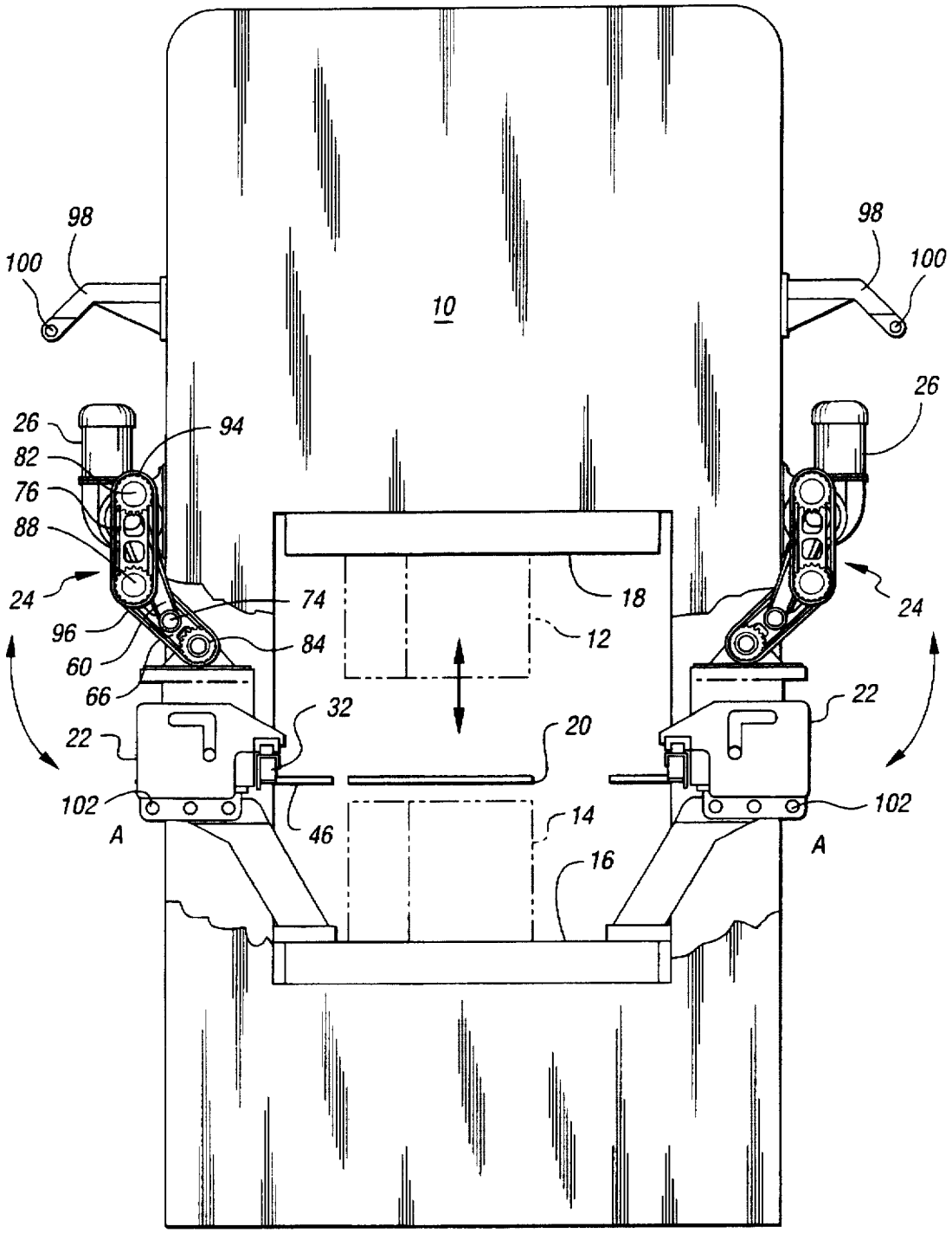
FIG. 2 is an end view of the stamping press and transfer system arrangement taken along line 2—2 of FIG. 1, showing the transfer system in an operable position indicated at A.

Referring first to FIGS. 1 and 2, a stamping press 10 is illustrated. An upper die 12 and a lower die 14 are mounted within the stamping press 10 (FIG. 2). Lower die 14 is secured to the press bed 16, and upper die 12 is secured to press ram 18. Upper die 12 is reciprocable with respect to lower die 14 for performing operations on workpieces 20. A pair of workpiece transfer systems 22 or parts transfer systems are positioned on laterally opposite sides of stamping press 10. The transfer systems 22 are each mounted to stamping press 10 by a pair of linkage assemblies 24. It is to be understood that the transfer systems 22 and linkage assemblies 24 are depicted as identical (FIG. 2) although they need not not be, and the following description will describe one side of stamping press 10. Further, it is to be understood that each transfer system 22 is secured by a pair of linkage assemblies 24 (FIG. 1) and the following description will describe one of such assemblies.

With reference to FIG. 1, each side of transfer system 22 is mounted to stamping press 10 by a linkage assembly 24. Linkage assembly 24 is driven by a drive means such as a gear reduction servomotor or servo drive unit 26. A driveshaft 28 extends from each side of the drive unit 26 to drive the linkages Alternatively, there could be two drive units 26, one at each linkage assembly 24 with a means for synchronizing movement of the two drive units.

Transfer system 22 includes a bridge truss support 30 mounted by a linkage 24 at each end. The other components of transfer system 22 are also supported by bridge truss support 30. A transfer finger bar 32 extends alongside the stamping press workstations for transfering parts from station to station. The transfer system 22 includes motor means such as servomotor 34 and associated driveshaft 36. Driveshaft 36 is connected to cam plate 38 to drive transfer finger bar 32. Pitch drive saddle 42 cooperates with belt 44 driven by a servomotor (not shown). The components of transfer system 22 cooperate in a conventional manner to transfer workpieces 20 between workstations. A least one gripping assembly 46 or finger arrangement is located along transfer finger bar 32 for engaging the workpieces during parts transfer. Columns 52 are fixed to stamping press 10 and have latch clamps 54 for securing transfer system 22 in the operable position.

Figure 5:
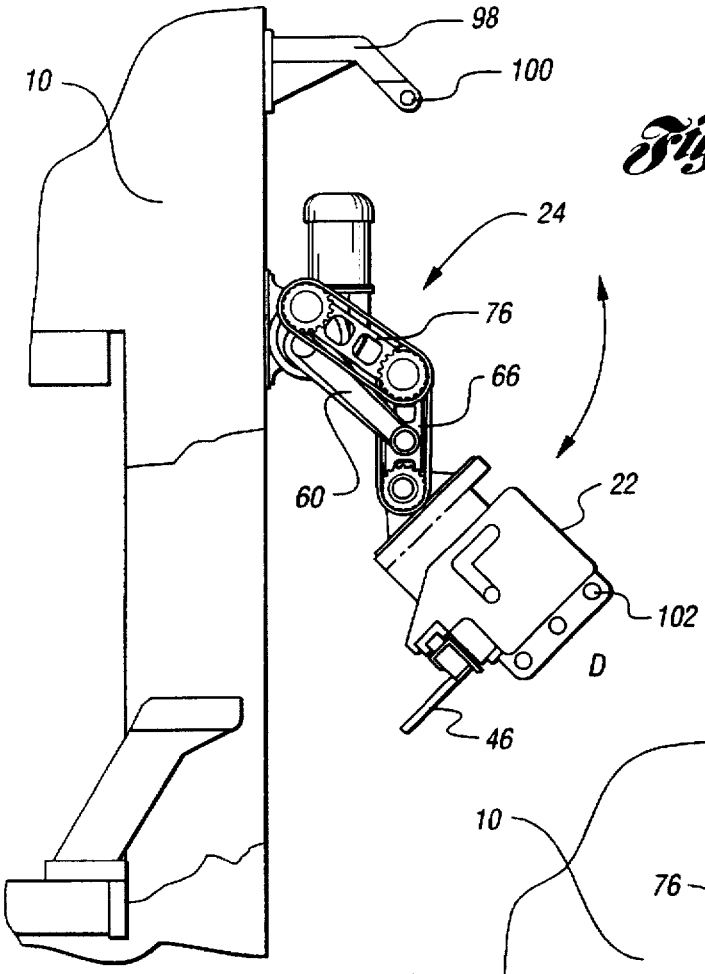
FIG. 5 is a partial side view of the transfer system, showing the transfer system in an alternative intermediate position indicated at D.
Figure 6:
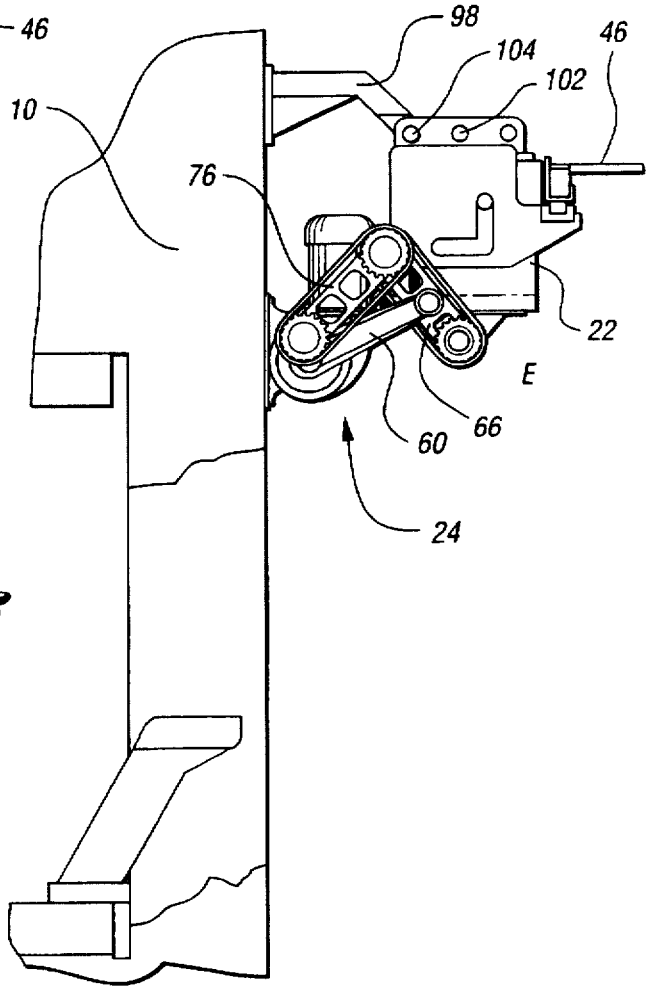
FIG. 6 is a partial side view of the transfer system, showing the transfer system in an alternative serviceable position indicated at E.
Figure 7:
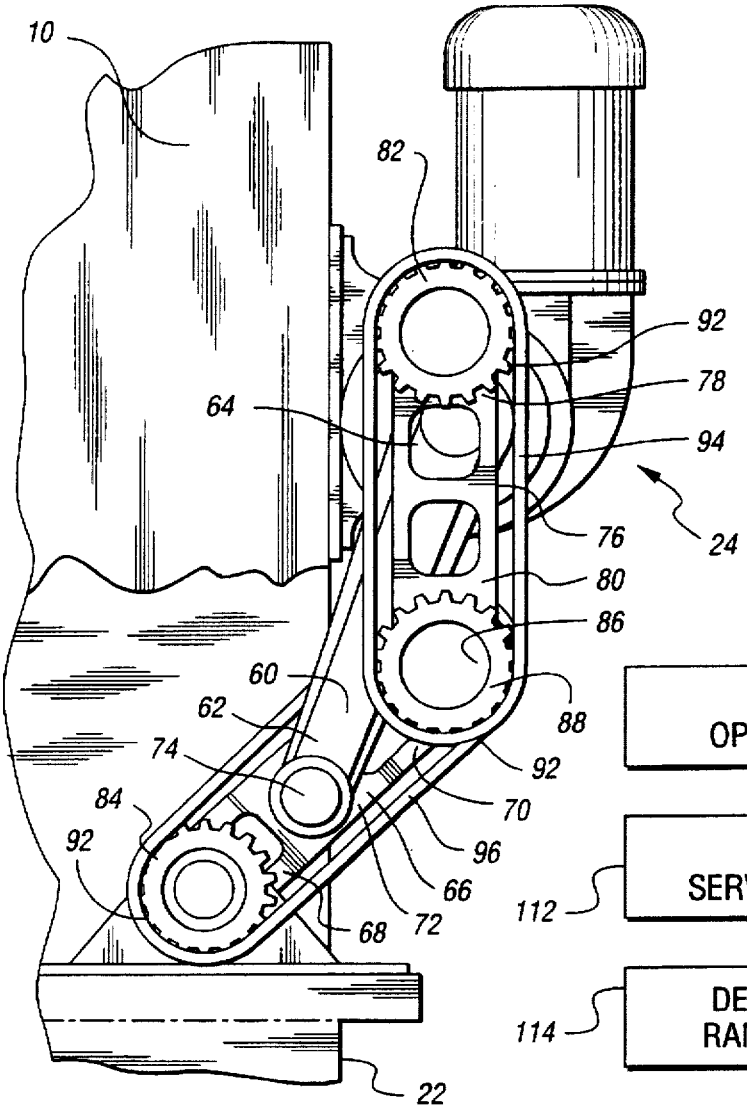
FIG. 7 is an enlarged view of the linkage arrangement mounting the transfer system to the stamping press.

Referring to FIGS. 2–7, and primarily to FIG. 7, linkage assembly 24 will be described in detail. Linkage 24 includes an input (driving) portion or reference gear 82 and an output (driven) portion or object gear 84. A crank arm 60 is mounted at its drive end 62 to stamping press 10. Swing end 64 of crank arm 60 is pivotally mounted to lead arm 66 of linkage 24. Lead arm 66 has a head end 68 and a tail end 70. An intermediate section 72 of lead arm 66 includes a bearing pivot 74 attaching lead arm 66 to swing end 64 of crank arm 60. Bearing pivot 74 is a conventional bearing pivot allowing pivotal movements of lead arm 66 as crank arm 60 is driven.

A follow arm 76 has a base end 78 and a free end 80. Base end 78 is pivotally mounted to stamping press 10 by a bearing pivot connection. Free end 80 of follow arm 76 is pivotally attached to tail end 70 of lead arm 66.

Transfer system 22 is mounted to head end 68 of lead arm 66. The dynamics of linkage assembly 24 allow transfer system 22 to be driven between an operable position indicated at A (FIG. 2), through a series of intermediate positions, one of such positions indicated at B (FIG. 3), to a serviceable position indicated at C (FIG. 4). An alternative intermediate position is indicated at D (FIG. 5). An alternative serviceable position is indicated at E (FIG. 6).

With continuing reference to FIGS. 2–7, a reference gear 82 is fixedly mounted to stamping press 10 so that it cannot rotate, i.e. reference gear 82 is mounted in a manner to preclude rotation of reference gear 82 with respect to stamping press 10. An object gear 84 is fixedly mounted to transfer system 22. Object gear 84 is mounted in a manner to preclude rotation of object gear 84 with respect to transfer system 22. First free gear 86 is mounted for rotation at free end 80 of follow arm 76. Second free gear 88 is mounted for rotation at tail end 70 of lead arm 66. First free gear 86 and second free gear 88 are coupled together by a shaft 90 (FIG. 1) for rotation together.

Each of the gears or sprockets have a plurality of teeth 92. Drive means such as timing belts or preferably timing chains interconnect the gears to rotate object gear 84 together with transfer system 22 as crank arm 60 is driven by drive unit 26. The first drive means 94 connects reference gear 82 and first free gear 86. The second drive means 96 connects second free gear 88 and object gear 84. Transfer system 22 is pivotally mounted at head end 68 of lead arm 66 for rotation with object gear 84.

In one embodiment (not shown), the object gears 84 of the linkage assemblies 24 are mounted proximate a principal axis of transfer system 22. The moment of inertia about the principal axis is the minimum moment of inertia of transfer system 22. Mounting the object gears 84 near the principal axis facilitates rotation of transfer system 22 while minimizing the torque on the object gears 82 during movement of transfer system 22, and when transfer system 22 is held in the serviceable position C (FIG. 4) or E (FIG. 6).

In a stamping operation, it is necessary that transfer system 22 has an operable position close enough to upper and lower die 12, so that workpiece transfer is possible. During initial setup of transfer system 22, the required operating position is determined. Also, it is necessary to determine a serviceable position for transfer system 22. When performing maintenance on stamping press 10 or other parts of the manufacturing system, it is very helpful to move transfer system 22 out of the way. However, there are often constraints on the serviceable position due to lack of space in the work place, or safety factors.

In accordance with the present invention, crank arm length, lead arm length, and follow arm length are determined for linkage assembly 24 based on the desired operable and serviceable positions. These arm lengths determine the position of head end 68 of lead arm 66 throughout linkage motion.

The selection of arm lengths in determining the operable and serviceable positions for transfer system 22 is supplemented by determining gear ratios among reference gear 82, object gear 84, and first and second free gears 86 and 88, respectively.

The angular position of object gear 84 determines the attitude of transfer system 22. The operable position A (FIG. 2) for transfer system 22 determines a reference attitude for the transfer system 22. As crank shaft 60 is driven by drive unit 36, first drive means 94 imparts motion to first free gear 86. Second free gear 88 rotates conjointly with first free gear 86. Second drive means 96 imparts motion to object gear 84, which rotates with transfer system 22. The arm lengths along with the gear ratios determine the serviceable position C (FIG. 4) or E (FIG. 6) or an other serviceable position for transfer system 22 with respect to operable position A (FIG. 2).

It should be appreciated that the motion of transfer system 22 can be precisely controlled with slight modifications to the gear ratios or arm lengths. In one embodiment, the gear ratios amongst the gears are predetermined so as to maintain substantially constant transfer system attitude during movement between the operable and serviceable positions (FIGS. 2–4).

In another embodiment, by changing the gear ratios, it is possible to have the transfer system 22 undergo a net change in attitude of about 180° during movement between the operable and serviceable positions (FIGS. 2, 5, and 6). This may be desired for a stamping operation in which the gripping assemblies 46 need to be accessed easily. Bracket 98 has a hole 100, and transfer system 22 has a plurality of holes 102. When transfer system 22 is in the serviceable position indicated at E (FIG. 6), a pin 104 can be positioned through hole 100 and one of holes 102 that is aligned with hole 100 to further secure the transfer system 22.

Figure 3:
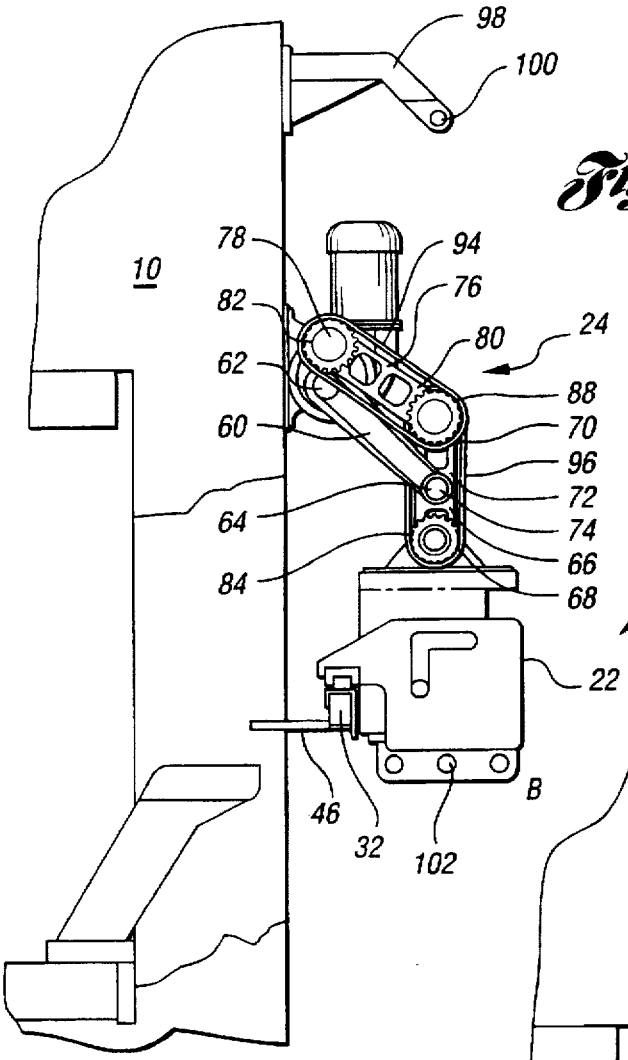
FIG. 3 is a partial side view of the transfer system, showing the transfer system in an intermediate position indicated at B.
Figure 4:
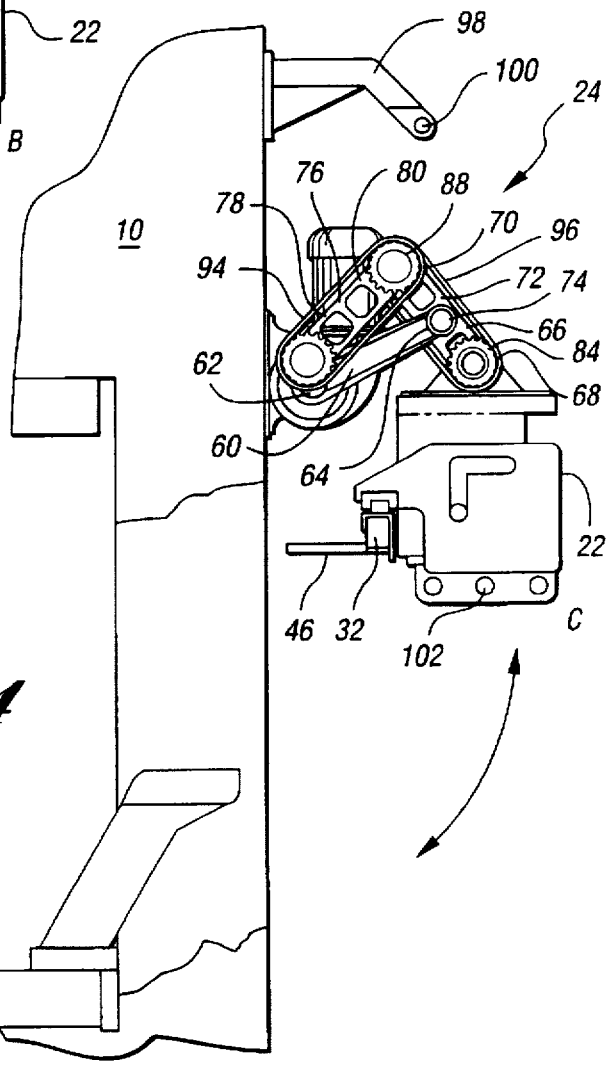
FIG. 4 is a partial side view of the transfer system, showing the transfer system in a serviceable position indicated at C.

With continuing reference to FIGS. 2–7, one example of the present invention will be further described. In a particular stamping operation it may be necessary for transfer system 22 to have an operable position that extends about 24 inches (61.0 centimeters) into stamping press 10, and to have a serviceable position that is about 12 inches (30.5 centimeters) outside of the press, and further to maintain the transfer system 22 in substantially constant attitude during movement between the operable and serviceable positions (FIGS. 2–4). One way to do this is to have a crank arm length of about 30 inches (76.2 centimeters), a lead arm length of about 24 inches (61.0 centimeters), and a follow arm length of about 24 inches (61.0 centimeters). The ratio of the reference gear 82 to first free gear 86 should be about 1 to 1. The ratio of first free gear 86 to second free gear 88 should be about 1 to 1, and the ratio of second free gear 88 to object gear 84 should be about 1.25 to 1. Reasonable tolerances will be apparent to one of ordinary skill in the art.

To impose on the transfer system 22 a net change in attitude of about 180° during movement between the operable and serviceable positions (FIGS. 2, 5, and 6), the gear ratio of second free gear 88 to object gear 84 is about 0.75 to 1, while maintaining the other gear ratios as described above.

Figure 8:
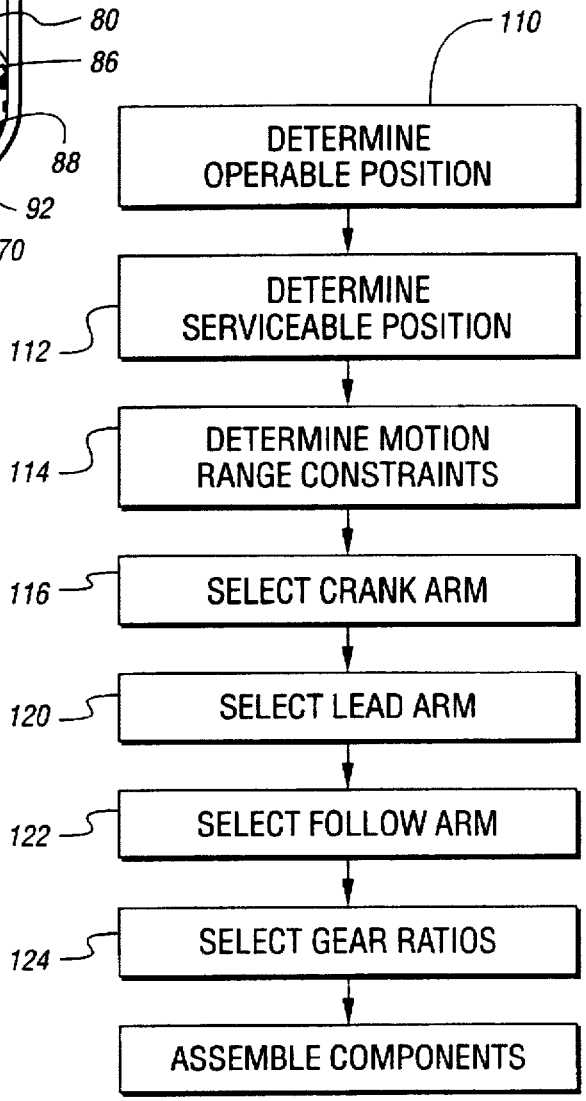
FIG. 8 is a block diagram illustrating a method for controlling movement of a transfer system in accordance with the present invention.

Referring to FIG. 8, a method for controlling movement of transfer system 22 in a manufacturing system such as stamping press 10 is described. The articulating, swing and lift feature of linkage assembly 24 is custom designed for each individual unique application. At step 110 an operable position for transfer system 22 is determined. The operable position must be sufficiently close to the dies so that gripping assemblies 46 can reach the workpieces 20. At step 112, a serviceable position for transfer system 22 is determined. The serviceable position is based on individual need, such as desiring the serviceable position to be very close to the press minimizing the space needed for motion of transfer system 22, or such as a serviceable position in which the attitude of transfer system 22 has undergone a net change ranging from about 90° to about 180° so that gripping assemblies 46 are more easily accessed.

At step 114, any motion range constraints for transfer system 22 during movements between the operable and serviceable positions are determined. For example, for safety reasons or because of other nearby equipment, it may be desirable that the transfer system 22 pass through any number of specific intermediate positions.

Crank arm, lead arm, and follow arm lengths are determined at steps 116,118, and 120, respectively. These steps, along with step 122, selecting gear ratios, can be done individually or simultaneously. The arm lengths and gear ratios precisely determine the complete motion range for transfer system 22 along with the complete range of attitudes for transfer system 22 during movement.

One method for selecting these parameters is to first select the operable position, and then select the serviceable based on die location and press geometry.

At step 124, the components are assembled, and the stamping press 10, transfer system 22, and linkage assemblies 24 are ready for operation.

It is to be appreciated that the press mounting feature of the present invention provides for the entire three-axis all servo transfer system to be vertically mounted to the stamping press overhead of the die operating area, thus freeing up the die and press area for other uses such as scrap removal, scrap conveyors, etc. This mounting feature also provides for ready die access, die repair, die change, and/or die removal without having to remove a fixed transfer system or work on, over, or around it.

Alternatively, a linkage assembly 24 may be constructed using a crank arm, and a plurality of swing arms connecting the crank arm to the transfer system 22. The plurality of swing arms define a plurality of pivot connections for linkage assembly 24. By providing multiple connections, the arm lengths can be selected so as to determine movement of the transfer system 22. This predetermined controlled movement of the transfer system 22 about multiple pivot axes can be further enhanced by providing gears or sprockets at these pivotal connections. Interconnecting these gears with drive means such as timing belts or chains will effectively control transfer system attitudes throughout the motion range.

The three-axis system that has been described in detail is sufficient for controlling motion of transfer system 22. However, it should be appreciated that by providing additional pivot axes and gears, or a different configuration of swing arms which defines multiple pivot axes, this motion may be more precisely controlled.

It should be appreciated that the above-described system and method could be retro-fit to an existing stamping press, or a complete linkage assembly and transfer system could be installed on a stamping press. Further, the previously described system could be used on either one side or both sides of the stamping press.

It is to be understood, of course, that while the forms of the invention described above constitute the preferred embodiments of the invention, the preceding description is not intended to illustrate all possible forms thereof. It is also to be understood that the words used are words of description, rather than limitation, and that various changes may be made without departing from the spirit and scope of the invention, which should be construed according to the following claims.

What is claimed is:

1. A system for controlling movement of a transfer system between operable and serviceable positions in a manufacturing system such as a stamping press, the system comprising:

a driveable crank arm mounted to the manufacturing system;

a plurality of swing arms connecting the crank arm to the transfer system, the plurality of swing arms being interconnected and defining a plurality of pivot connections so as to control movement of the transfer system between the operable and serviceable positions when the crank arm is driven; and an adjustable drive mechanism connecting the manufacturing system to the transfer system to rotate the transfer system with respect to the manufacturing system as the crank arm is driven, wherein the drive mechanism allows selection of transfer system attitudes during movement based on desired operable and serviceable positions.

2. The system of claim 1 wherein the crank arm and each of the plurality of swing arms have predetermined lengths based on desired operable and serviceable positions.

3. The system of claim 1 wherein the plurality of swing arms comprises:

a lead arm having a head end, a tail end, and an intermediate section between its head and tail ends, the intermediate section pivotally attaching the lead arm to the crank arm; and a follow arm having a base end and a free end, the base end being mounted to the manufacturing system, the free end being attached to the tail end of the lead arm, wherein the head end of the lead arm is mountable to the transfer system so as to control movement of the transfer system.

4. The system of claim 3 wherein the drive mechanism comprises:

a reference gear fixedly mounted to the manufacturing system to preclude rotation of the reference gear with respect to the manufacturing system;

an object gear fixedly mounted to the transfer system to preclude rotation of the object gear with respect to the transfer system;

a first free gear rotatably mounted at the free end of the follow arm;

a second free gear rotatably mounted at the tail end of the lead arm and coupled to the first free gear;

a first drive means connecting the reference gear and first free gear so as to rotate the first free gear as the free end of the follow arm moves in response to the crank arm being driven; and a second drive means connecting the second free gear and object gear so as to rotate the object gear together with the transfer system as the second free gear rotates, thereby rotating the transfer system with respect to the lead arm as the crank arm is driven.

5. A linkage for connecting a transfer system to a manufacturing system such as a stamping press, the linkage comprising:

a driveable crank arm having a drive end and a swing end, the drive end being mountable to the manufacturing system;

a lead arm having a head end, a tail end, and an intermediate section between its head and tail ends, the intermediate section pivotally attaching the lead arm to the swing end of the crank arm;

a follow arm having a base end and a free end, the base end being mountable to the manufacturing system, the free end being attached to the tail end of the lead arm, wherein the head end of the lead arm is mountable to the transfer system so as to control movement of the transfer system between an operable position and a serviceable position when the crank arm is driven; and an adjustable drive mechanism connecting the manufacturing system to the transfer system to rotate the transfer system with respect to the manufacturing system as the crank arm is driven, wherein the drive mechanism allows selection of transfer system attitudes during movement based on desired operable and serviceable positions.

6. The linkage of claim 5 wherein the crank arm, lead arm, and follow arm each have predetermined lengths based on desired operable and serviceable positions.

7. The linkage of claim 6 wherein the drive mechanism comprises:

a reference gear fixedly mounted to the manufacturing system to preclude rotation of the reference gear with respect to the manufacturing system;

an object gear fixedly mounted to the transfer system to preclude rotation of the object gear with respect to the transfer system;

a first free gear rotatably mounted at the free end of the follow arm;

a second free gear rotatably mounted at the tail end of the lead arm and coupled to the first free gear;

a first drive means connecting the reference gear and first free gear so as to rotate the first free gear as the free end of the follow arm moves in response to the crank arm being driven; and a second drive means connecting the second free gear and object gear so as rotate the object gear together with the transfer system as the second free gear rotates, thereby rotating the transfer system with respect to the lead arm as the crank arm is driven.

8. The linkage of claim 7 wherein the object gear is fixedly mounted to the transfer system proximate a principal axis of the transfer system.

9. The linkage of claim 7 wherein the first free gear and the second free gear are coupled by a shaft for rotation together.

10. The linkage of claim 7 wherein the gears have predetermined gear ratios based on desired operable and serviceable positions.

11. The linkage of claim 10 wherein gear ratios are predetermined so as to maintain substantially constant transfer system attitude during movement between the operable and serviceable positions.

12. The linkage of claim 10 wherein gear ratios are predetermined so that the transfer system undergoes a net change in attitude of about 180° during movement between the operable and serviceable positions.

13. The linkage of claim 10 wherein crank arm length is about 30 inches, lead arm length is about 24 inches, and follow arm length is about 24 inches, and wherein the gear ratio of the reference gear to the first free gear is about 1 to 1, the gear ratio of the first free gear to the second free gear is about 1 to 1, and the gear ration of the second free gear to the object gear is about 1.25 to 1.

14. The linkage of claim 10 wherein crank arm length is about 30 inches, lead arm length is about 24 inches, and follow arm length is about 24 inches, and wherein the gear ratio of the reference gear to the first free gear is about 1 to 1, the gear ratio of the first free gear to the second free gear is about 1 to 1, and the gear ration of the second free gear to the object gear is about 0.75 to 1.

15. In combination with a stamping press, a system for indexing workpieces between workstations in the stamping press, the system comprising:

a transfer system including at least one set of gripping assemblies for securing a workpiece, the transfer system being capable of indexing a workpiece from one workstation to another workstation;

a driveable crank arm mounted to the stamping press;

a plurality of swing arms connecting the crank arm to the transfer system, the plurality of swing arms being interconnected and defining a plurality of pivot connections so as to control movement of the transfer system between operable and serviceable positions when the crank arm is driven; and an adjustable drive mechanism connecting the manufacturing system to the transfer system to rotate the transfer system with respect to the manufacturing system as the crank arm is driven, wherein the drive mechanism allows selection of transfer system attitudes during movement based on desired operable and serviceable positions.

16. The system of claim 15 wherein the plurality of swing arms comprises:

a lead arm having a head end, a tail end, and an intermediate section between its head and tail ends, the intermediate section pivotally attaching the lead arm to the crank arm; and a follow arm having a base end and a free end, the base end being mounted to the manufacturing system, the free end being attached to the tail end of the lead arm, wherein the head end of the lead arm is mounted to the transfer system so as to control movement of the transfer system.

17. The system of claim 16 wherein the drive mechanism comprises:

a reference gear fixedly mounted to the manufacturing system to preclude rotation of the reference gear with respect to the manufacturing system;

an object gear fixedly mounted to the transfer system to preclude rotation of the object gear with respect to the transfer system;

a first free gear rotatably mounted at the free end of the follow arm;

a second free gear rotatably mounted at the tail end of the lead arm and coupled to the first free gear for rotation therewith;

a first drive means connecting the reference gear and first free gear so as to rotate the first free gear as the free end of the follow arm moves in response to the crank arm being driven; and a second drive means connecting the second free gear and object gear so as rotate the object gear together with the transfer system as the second free gear rotates, thereby rotating the transfer system with respect to the lead arm as the crank arm is driven.

18. A method for controlling movement of a transfer system in a manufacturing system such as a stamping press, the method comprising the steps of:

determining operable and serviceable positions for the transfer system based on die location and press geometry;

selecting a crank arm, lead arm, and follow arm, each having a length based on the operable and serviceable positions;

connecting the crank arm, lead arm, and follow arm so as to control movement of the transfer system between the operable and serviceable positions;

determining desired transfer system attitudes in the operable and serviceable positions;

selecting a reference gear, object gear, and first and second free gears, the gears having gear ratios based on the desired transfer system attitudes;

mounting the reference gear to the stamping press at an end of the follow arm so as to preclude rotation of the reference gear with respect to the stamping press;

mounting the object gear to the transfer system at an end of the lead arm so as to preclude rotation of the object gear with respect to the transfer system;

mounting the first and second free gears at a pivot connection defined by the lead and follow arms, the first and second free gears being coupled for rotation together;

connecting the reference gear to the first free gear with a first drive means; and connecting the second free gear to the object gear with a second drive means so as to rotate the object gear together with the transfer system as the transfer system moves between the operable and serviceable positions.

19. The method of claim 18 further comprising the step of:

providing motor means connected to the crank arm, the servomotor being operable to drive the crank arm, thereby imparting motion to the transfer system.

* * * * *